US005154668A

United States Patent [19]

Schubert

[11] Patent Number: 5,154,668

[45] Date of Patent: Oct. 13, 1992

[54] SINGLE PAPER SHEET FORMING A TWO-SIDED COPY OF INFORMATION ENTERED ON BOTH SIDES THEREOF

[76] Inventor: Keith E. Schubert, 11 Vincent Dr., Monroe, Conn. 06468

[21] Appl. No.: 497,219

[22] Filed: Mar. 22, 1990

Related U.S. Application Data

[63] Continuation-in-part of Ser. No. 494,565, Mar. 16, 1990, Pat. No. 5,151,494, which is a continuation-in-part of Ser. No. 484,686, Feb. 23, 1990, abandoned, which is a continuation-in-part of Ser. No. 436,189, Nov. 13, 1989, which is a continuation-in-part of Ser. No. 334,183, Apr. 16, 1989, Pat. No. 5,127,879.

[51] Int. Cl.[5] ..... B41L 1/20; B41L 1/22

[52] U.S. Cl. ..... 462/25; 462/53; 462/54; 462/17; 462/18; 462/66; 462/69; 462/84; 503/205; 503/222; 283/116

[58] Field of Search ..... 282/1 R, 2, 1 A, 3 R, 282/8 R, 9 R, 12 R, 12 A, 11.5 R, 11.5 A, 15 B, 22 R, 27.5; 283/446; 503/205, 222; 462/25, 53, 54, 17, 18, 66, 69, 54

[56] References Cited

U.S. PATENT DOCUMENTS 371,126 10/1887 Currie .
396,560 1/1889 Harrison et al. .
418,455 12/1889 Gray .
419,359 1/1890 Rogers .
445,368 1/1891 Campbell .
664,384 12/1900 Cooke .
683,782 10/1901 Morland .
756,258 4/1904 Mallin .
765,408 7/1904 Wildey .
797,302 8/1905 Meacham .
897,783 9/1908 Reynolds .
971,283 9/1910 Krueger .
972,549 10/1910 Lewis .
1,101,262 6/1914 Edmonds .
1,187,682 6/1916 Trueman ..... 282/12
1,301,834 4/1919 Gilman .
1,392,748 10/1921 Davidson .
1,468,094 9/1923 Wherry .
1,873,997 8/1932 Davis .
1,980,318 11/1934 Caton .
1,980,319 11/1934 Caton .
2,006,034 6/1935 Stevens .
2,035,768 3/1936 Sherman et al. ..... 91/68
2,084,221 6/1937 Schutz .
2,093,086 9/1937 Luzzatto ..... 282/27

(List continued on next page.)

OTHER PUBLICATIONS

Seven page descripton of U.S. Pat. Nos. 4,715,620 and 4,762,342 by Gary J. Thompson.

*Primary Examiner*—Paul A. Bell
*Attorney, Agent, or Firm*—Gerald E. Linden

[57] ABSTRACT

A single sheet of paper is divided into at least original and copy panels by fold line(s). Information entered on the two, front and back surfaces of the original panel are reproduced on the two surfaces of the copy panel by carbonless copy treatments. In one embodiment, the original panel is fully coated or partially coated with carbonless CB treatment, on both surfaces, and the copy panel is fully coated or partially coated with carbonless CF treatment. In a variation of this embodiment, the original panel is not coated, and the copy panel is coated in selected areas with carbonless SC treatment. In a second embodiment, the original panel is not coated, an image-transferring panel is fully coated on both surfaces with carbonless CB treatment, and the copy panel is fully coated with carbonless CF treatment. In a variation of this embodiment, the image-transferring panel is formed of a separate sheet of paper. In a third embodiment, the original panel is coated on both sides with a carbonless CB treatment from a first carbonless system, a first copy panel is coated with a carbonless CF treatment from the first carbonless system and with a carbonless CB treatment from a second carbonless system, and a second copy panel is coated with a carbonless CF treatment from the second carbonless system. In a variation of this embodiment, the original panel is simply an iamge-transferring panel, and a separate panel clear of carbonless coating is employed.

2 Claims, 3 Drawing Sheets

U.S. PATENT DOCUMENTS

| | | | |
|---|---|---|---|
| 2,098,706 | 4/1937 | Lawson et al. | 282/12 |
| 2,118,888 | 5/1938 | Lewis et al. | 101/131 |
| 2,131,381 | 9/1938 | Linderman | 282/28 |
| 2,148,886 | 2/1939 | Wanser | 229/69 |
| 2,168,098 | 8/1939 | Groák | 282/26 |
| 2,194,670 | 3/1940 | Neu | 282/27 |
| 2,211,532 | 8/1940 | Biggs | 282/12 |
| 2,220,842 | 11/1940 | Hano | 282/12 |
| 2,226,722 | 12/1940 | Jones | 282/22 |
| 2,257,766 | 10/1941 | Sherman | 282/3 |
| 2,262,347 | 11/1941 | Sturc | 282/26 |
| 2,264,119 | 11/1941 | Lichter | 283/1 |
| 2,327,215 | 8/1943 | Potter | 282/12 |
| 2,458,729 | 1/1949 | Politzer | 40/102 |
| 2,470,586 | 5/1949 | Tathwell | 282/9 |
| 2,548,366 | 4/1951 | Green et al. | 282/28 |
| 2,550,466 | 4/1951 | Green et al. | 282/28 |
| 2,550,468 | 4/1951 | Green et al. | 282/28 |
| 2,550,469 | 4/1951 | Green et al. | 282/28 |
| 2,606,775 | 8/1952 | Newman | 282/28 |
| 2,618,573 | 11/1952 | Green | 117/36 |
| 2,637,571 | 5/1953 | Tilly | 281/5 |
| 2,694,429 | 11/1954 | Berger | 150/39 |
| 2,712,507 | 7/1955 | Green | 117/36 |
| 2,802,678 | 8/1957 | Bright | 282/22 |
| 2,869,898 | 1/1959 | Martin . | |
| 2,870,040 | 1/1959 | Gill | 117/36 |
| 2,907,585 | 10/1959 | Sornberger | 282/22 |
| 2,980,447 | 4/1961 | Weger | 282/22 |
| 3,016,308 | 1/1962 | Macaulay | 117/36.7 |
| 3,104,799 | 9/1963 | Steidinger | 229/69 |
| 3,364,052 | 1/1968 | Martino | 117/15 |
| 3,429,827 | 2/1969 | Ruus | 252/316 |
| 3,481,759 | 12/1969 | Ostlie | 117/36.2 |
| 3,539,375 | 11/1970 | Baum | 117/36.2 |
| 3,625,547 | 12/1971 | Burke | 282/23 |
| 3,682,681 | 8/1972 | Kunkel | 117/36.2 |
| 3,769,057 | 10/1973 | Lin | 117/36.2 |
| 3,769,062 | 10/1973 | Ishige et al. | 117/36.2 |
| 3,825,467 | 7/1974 | Phillips, Jr. | 161/159 |
| 3,854,654 | 12/1974 | Van Malderghem | 229/69 |
| 3,902,655 | 9/1975 | Huffman | 229/69 |
| 3,945,870 | 3/1976 | Johnsen | 156/201 |
| 3,955,750 | 5/1976 | Huffman | 229/69 |
| 3,968,299 | 7/1976 | Angleman | 428/307 |
| 3,981,523 | 9/1976 | Maalouf | 282/27.5 |
| 4,000,916 | 1/1977 | Lucas | 282/11.5 |
| 4,036,511 | 1/1977 | Maalouf | 282/27.5 |
| 4,039,046 | 8/1977 | D'Luhy | 282/22 R |
| 4,045,053 | 8/1977 | Carriere | 282/22 R |
| 4,046,404 | 9/1977 | Treier | 282/27.5 |
| 4,056,191 | 11/1977 | Weisenfluh | 206/629 |
| 4,062,567 | 12/1977 | Macaulay | 282/27.5 |
| 4,063,754 | 12/1977 | Schackle et al. | 282/27.5 |
| 4,081,188 | 3/1978 | Westcott | 282/27.5 |
| 4,091,122 | 5/1978 | Davis et al. | 427/44 |
| 4,097,619 | 6/1978 | Davis et al. | 427/44 |
| 4,111,461 | 9/1978 | Levensalor | 282/27.5 |
| 4,112,138 | 9/1978 | Davis et al. | 427/54 |
| 4,113,281 | 9/1978 | Halse | 282/11.5 A |
| 4,121,857 | 10/1978 | Halse | 282/11.5 A |
| 4,126,334 | 11/1978 | Van Malderghem | 282/22 R |
| 4,137,343 | 1/1979 | Davis et al. | 427/150 |
| 4,138,302 | 2/1979 | D'Luhy | 156/216 |
| 4,139,218 | 2/1979 | Davis et al. | 282/27.5 |
| 4,139,392 | 2/1979 | Davis et al. | 106/14.5 |
| 4,143,890 | 3/1979 | Davis et al. | 282/27.5 |
| 4,143,891 | 3/1979 | Neubauer | 282/27.5 |
| 4,165,101 | 8/1979 | Sternberg | 282/27.5 |
| 4,168,851 | 9/1979 | Halse | 282/11.5 A |
| 4,172,605 | 10/1979 | Welsh et al. | 282/27.5 |
| 4,178,018 | 12/1979 | Halse | 282/11.5 A |
| 4,198,446 | 4/1980 | Goetz | 427/150 |
| 4,199,174 | 4/1980 | Sornberger | 282/27.5 |

FOREIGN PATENT DOCUMENTS

| | | |
|---|---|---|
| 549442 | 4/1932 | Fed. Rep. of Germany . |
| 613658 | 11/1926 | France . |
| 128558 | 3/1962 | New Zealand . |
| 128915 | 3/1964 | New Zealand . |
| 185282 | 11/1980 | New Zealand . |
| 2085359 | 4/1982 | United Kingdom . |

SINGLE PAPER SHEET FORMING A TWO-SIDED COPY OF INFORMATION ENTERED ON BOTH SIDES THEREOF

This is a continuation-in-part of U.S. patent application Ser. No. 494,565 filed Mar. 16, 1990, U.S. Pat. No. 5,137,494 which is a continuation-in-part of U.S. Ser. No. 484,686 filed Feb. 23, 1990 now abandoned which is a continuation-in-part of U.S. patent application Ser. No. 436,189 filed Nov. 13, 1989, which is a continuation-in-part of U.S. patent application No. 334,183 filed Apr. 6, 1989 U.S. Pat. No. 5,127,879.

TECHNICAL FIELD OF THE INVENTION

The invention relates to carbonless copying techniques.

BACKGROUND OF THE INVENTION

Carbonless copy forms are well known. A typical two-part form includes a top sheet having a coated back (CB) containing microencapsulated (generally colorless) dye, and a bottom sheet having a coated front (CF) containing a reactive dye-revealing substance. The top and bottom sheets are assembled, such as by gluing, into a "manifold", or many part set. The pressure of writing on the front surface of the top sheet causes the encapsulated dye on the CB-coated back surface of the top sheet to rupture, releasing dye onto the CF-coated front surface of the bottom sheet, whereupon the writing is revealed in a contrasting (visible) color on the front surface of the bottom sheet.

Multiple carbonless copies are produced in a similar manner. One or more intermediate sheets are assembled between the top and bottom sheets. Each intermediate sheet has a carbonless front (CF) coating on its front surface for revealing the dye from the previous sheet, and has a carbonless back (CB) coating on its back surface for releasing dye to the next sheet in the set.

With these techniques, one or more carbonless copies of information entered on the front surface of the original (top) sheet can be reproduced on a surface of the copy (intermediate and bottom) sheets.

The chemistry of the CB and CF coatings is well known, as are techniques for applying these coatings to paper stock.

A variation of the above is found in so-called "two-way write" systems. One such example is found in U.S. Pat. No. 4,000,916, issued to Lucas, which describes a manifold report form having three superimposed record sheets (top, middle and bottom). Carbon sheets and protective sheets are arranged between the record sheets. Information entered on the front surface of the top record sheet is reproduced on the front surfaces of the middle and bottom sheets. The form is then flipped over, in its entirety, and various carbon and protective sheets are removed. Information entered on the back surface of the bottom sheet is reproduced on the back surface of the middle and top sheets.

With such two-way write systems, a true original is not formed. Rather, each of the top and bottom sheets contains "original" (e.g., hand written) information on only one surface, and "copy" (reproduced by carbon paper or the CB/CF dye reaction) information on the other surface. Such a bifurcation of the original information is unsuitable in many applications, such as for legal forms.

U.S. Pat. Nos. 4,715,620 and 4,762,342, issued to Thompson, attempt to solve the challenge of providing a "true" original where the top sheet has "original" information on the front and back surfaces thereof. Therein, top, intermediate and bottom sheets are assembled into a manifold having a stub. Patterned carbon papers and/or carbonless coatings are employed, between the various sheets, as in the two-way write systems. Information is entered on the front surface of the top sheet. The top sheet is then folded around the stub so that its front surface is in contact with the back surface of the bottom sheet. Additional information is then entered on the exposed back surface of the top sheet. The front surface of the top sheet is coated with carbonless CB and the back surface of the bottom sheet is coated with carbonless CF so that the information entered on the back surface of the top sheet is reproduced on the back surface of the bottom sheet.

The problems with Thompson's techniques include the following: 1) It is extremely difficult to maintain registration (alignment) of the top sheet when it is folded around the stub. Hence, it is suggested by Thompson that the stub be gently folded over along with the top sheet. This causes a gap between the top sheet and bottom sheet, which is in apposite to carbonless image forming. The top sheet, when folded over the stub in this manner, must be smoothed out prior to entering the additional information on the back surface of the top sheet. Additionally, if the stub is not folded properly, the top sheet will not be in register with the other sheets when it is flipped over for entering information on the back surface thereof. 2) The carbonless CB coating on the front surface of the top sheet is difficult to write upon. For instance, the tip of a ball point pen will tend to become clogged by dye released from the microcapsules in short order.

The implementation of all of the above-described manifold forms is further complicated by the need for machinery necessary to collate, glue and/or staple individual, dissimilarly coated sheets of paper, carbon papers and protective sheets into a manifold arrangement. This necessitates costly set up charges for the equipment, creates delays in going from paper stock to preprinted form, and creates cumbersome inventory requirements.

DISCLOSURE OF THE INVENTION

Hence, it is an object of the present invention to provide a technique for producing carbonless copies of information entered on both the front and back surfaces of an original sheet without the problems of writing on carbonless coatings and without the difficulties attendant to manifold arrangements, such as their dissimilar sheets and stubs.

It is a further object of the invention to provide a technique for producing carbonless copy forms with only commonplace printing equipment, in other words without additional collators, gluers, staplers and the like.

It is a further object of the invention to provide a technique for producing "blank" forms that can be readily imprinted with "fixed" information.

As used herein, "fixed" information refers to information imprinted on a form before it is filled out by a user. "Variable" information refers to information entered by the user on the form.

It is a further object of the invention to provide a technique for producing carbonless copy forms where the paper stock is readily manufacturable by the roll, and readily converted from bulk roll form into individual sheets.

According to the invention, a single sheet of paper is divided by fold lines into two or more panels (portions), one of which serves as an "original" panel for entering information on both sides thereof, another of which serves as a "copy" panel for reproducing the information entered on both the front and back surfaces of the original panel, and (in the case of three panels) one of which acts in conjunction with the copy panel to reproduce the information entered on both surfaces of the original panel.

Throughout the various embodiments described herein, the fold lines are preferably perforated to facilitate folding the various panels for filling out variable information, and for separating the various panels after they are filled out.

In a first embodiment, a single sheet of paper is divided by a fold line into two panels, an "original" panel and a "copy" panel. Folded a first way, the original and copy panels are in back-to-back relationship, and the front surface of the original panel is exposed for writing. Information entered in a first area on the front surface of the original panel is reproduced on the back surface of the copy panel. This is accomplished by applying a carbonless CB coating to an area on the back surface of the original panel directly behind the first area on the front surface of the original panel, and by applying a carbonless CF coating to an area on the back surface of the copy panel which is aligned with the CB-coated area on the back surface of the original panel when the sheet of paper is folded the first way. Folded a second way, the original and copy sheets are in front-to-front relationship, and the back surface of the original panel is exposed for writing. Information entered in a second area on the back surface of the original panel is reproduced on the front surface of the copy panel. This is accomplished by applying a carbonless CB coating to an area on the front surface of the original panel directly opposed to the second area on the back surface of the original panel, and by applying a carbonless CF coating to an area on the front surface of the copy panel which is aligned with the CB-coated area on the front surface of the original panel when the sheet of paper is folded the second way.

In an alternate configuration of the first embodiment, the original panel has first and second specific areas on its front and back surfaces, respectively, for filling in information, but is not coated with any carbonless treatment. The areas on the back and front surfaces of the copy panel which reproduce the information entered on the original panel are treated with a carbonless SC ("self-contained" mixture of CB and CF) treatment.

In both of these "patterned" configurations where first and second areas on the front and back surfaces, respectively, of the original panel are specified for filling in information, the areas are offset, in other words non-aligned front-to-back, on the original panel.

In designing these configurations, such as with a computer, this offset must be ensured, and any overlap of the first and second areas would automatically initiate a visual indication of the overlap (such as on a computer screen), and the form designer would have to reposition one or the other of the overlapping areas.

In another alternate configuration of the first embodiment, the front and back surfaces of the original panel are substantially fully coated with carbonless CB treatment, and the front and back surfaces of the copy panel are substantially fully coated with carbonless CF treatment. Since the CB coating on the original panel may tend to clog (ball point) pens, it is preferred that an impact-type printer or typewriter be used with this configuration.

In yet another alternate configuration of the first embodiment, a three panel sheet is provided. One of the panels is the original panel, another is a first copy panel and the remaining panel is a second copy panel. Patterned coatings are employed to reproduce on each of the first and second copy panels information entered on both sides of the original panel.

In a second embodiment, a single sheet of paper is divided by two fold lines into three panels, an "original" panel, a "copy" panel and a "magic", image-transferring panel. The term "magic" panel is coined. Folded a first way, the image-transferring panel resides between the original panel and the copy panel, and information entered on one surface of the original panel is reproduced on one surface of the copy panel. This is accomplished by a CB coating on one surface of the image-transferring panel and a CF coating on the one surface of the copy panel. Folded a second way, the image-transferring panel resides between the original panel and the copy panel, and information entered on an opposite surface of the original panel is reproduced on an opposite surface of the copy panel. This is accomplished by a CB coating on an opposite surface of the image-transferring panel and a CF coating on the opposite surface of the copy panel.

Alternate arrangements of the original, copy and magic panels as end or middle panels of this "tri-fold" are disclosed.

In an alternate configuration of the second embodiment, the original and copy panels are formed of a single sheet, and the magic panel is formed of a separate sheet.

In a third embodiment, a single sheet of paper is divided by two fold lines into three panels, an original panel, a first copy panel and a second copy panel. Two carbonless systems are employed: the first including "CB1" capable of reacting with "CF1"; and the second including "CB2" capable of reacting with "CF2", but not capable of reacting with "CF1". U.S. Pat. No. 4,062,567, entitled DUAL SYSTEM CARBONLESS SYSTEM, discloses an exemplary chemistry for this two-carbonless-system embodiment, in the context of producing CFB sheets. In this third embodiment, the original panel is substantially fully coated, back and front, with carbonless CB1, for transmitting images created on the front and back, respectively of the original panel. The first copy panel is substantially fully coated, front and back, with carbonless CF1, for revealing the images from the original panel, and is further coated, front and back, with carbonless CB2 for retransmitting the images to the second copy panel. The second copy panel is substantially fully coated, front and back, with carbonless CF2, for revealing the images. In this manner, two double-sided copies are made. In light of the potential pen tip clogging problem of having a substantially fully coated original panel, it is preferred that this embodiment is employed mainly for impact-type printing operations (e.g., computer printers, etc.).

Other objects, features and advantages of the invention will become apparent in light of the following description thereof.

Generally, throughout the descriptions that follow, a sheet of paper has a front surface and a back surface and is divided (by fold lines) into panels. Each of the panels has a front surface defined by the front surface of the sheet and a back surface defined by the back surface of the sheet.

DETAILED DESCRIPTION OF THE INVENTION

First Embodiment

Figure 2:
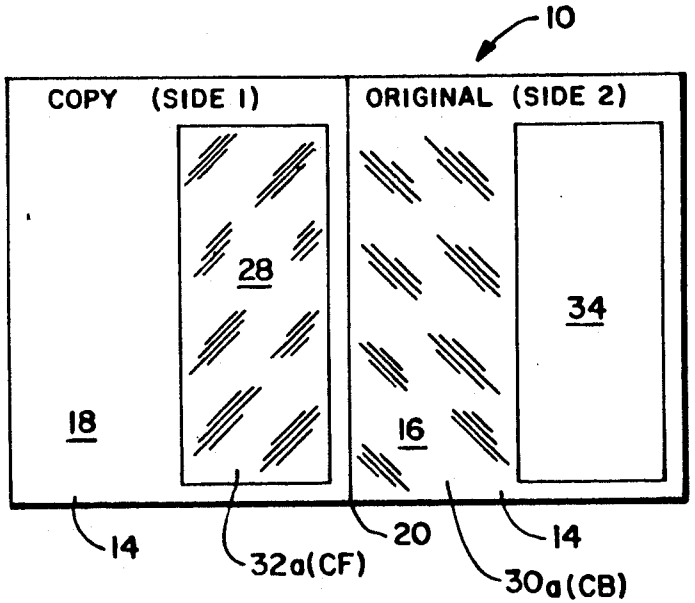
FIGS. 1, 2 and 3 are top plan, bottom plan and cross-sectional views, respectively, of the first embodiment of the invention.
Figure 1:
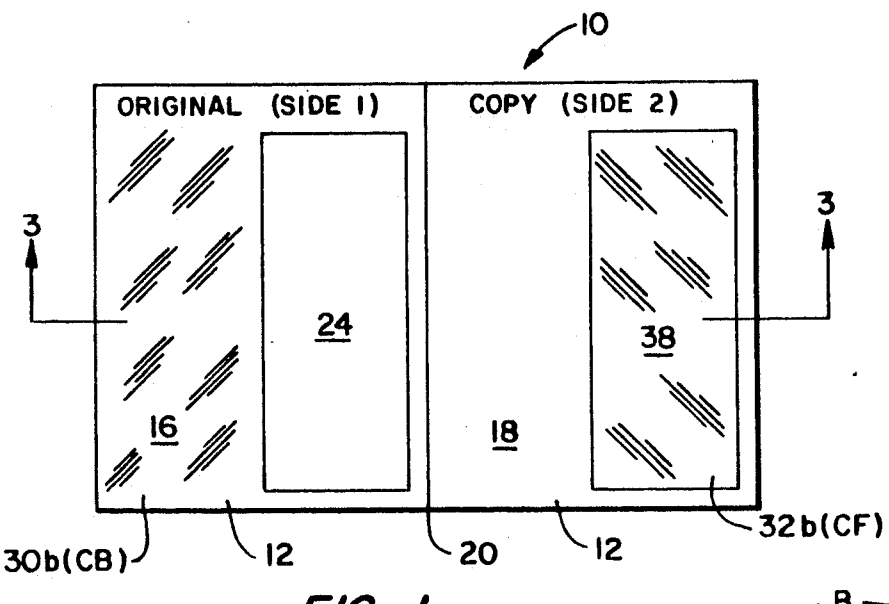
Figure 3:
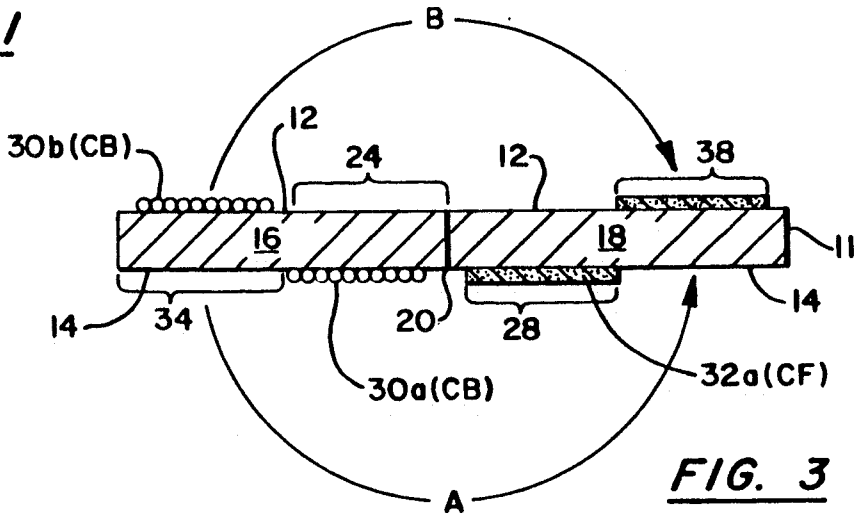

FIGS. 1, 2 and 3 show a self-replicating form 10 comprising a single sheet of paper 11 having a front surface 12 and a back surface 14. The sheet is divided into an "original" panel 16 and a "copy" panel 18 by a fold line 20. The fold line is provided with a series of perforations for folding and separating the two panels 16, 18.

A specific area 24 on the front surface of the original panel is designated for the user filling in variable information. The remaining area of the front surface of the original panel may be utilized for providing pre-printed, fixed information on the form.

When the form 10 is folded in a first direction along the fold line 20, the original and copy panels are in back-to-back relationship, as indicated by an arrow "A". An area 28 on the back of the copy panel is thus aligned with the area 24 on the front of the original panel. A carbonless CB treatment 30*a* is applied to an area on the back of the original panel in front-to-back alignment (on the original panel) with the area 24, and a carbonless CF treatment 32*a* is applied to the area 28 on the back of the copy panel. In this manner, variable information entered in the area 24 of the front surface of the original panel is reproduced in the area 28 on the back surface of the copy panel.

A specific area 34 on the back surface on the original panel is designated for the user filling in variable information. The remaining area on the back surface of the original panel may be utilized for providing preprinted, fixed information on the form.

When the form 10 is folded in a second, opposite direction along the fold line 20, the original and copy panels are in front-to-front relationship, as indicated by an arrow "B". An area 38 on the front of the copy panel is thus aligned with the area 34 on the back of the original panel. A carbonless CB treatment 30*b* is applied to an area on the front of the original panel in front-to-back alignment with the area 34, and a carbonless CF treatment 32*b* is applied to the area 38 on the front of the copy panel. In this manner, variable information entered in the area 34 of the back surface of the original panel is reproduced in the area 38 on the front surface of the copy panel.

Notably, the areas 24 and 34 on the front and back surfaces, respectively, of the original panel are clear (void) of any carbonless coatings, which completely avoids any problem with writing in these areas. In order to effect this goal, the areas 24 and 34 are advertently offset, i.e. not aligned front-to-back on the original panel.

Software for designing forms is readily modified to ensure that the areas, on the front and back of the original panel, are offset in this manner. Further, various geometric configurations of the areas for entering information are created, including those wherein the total area covered by the offset areas on the front and back of the original panel occupy a surface area substantially equivalent to the area of one surface of the original panel.

Paper for the form 10 can be mass produced in a roll, by applying vertical (as shown) stripes of carbonless CB and CF coatings to the bulk paper. The roll of paper can then be cut (horizontally, as shown) into individual forms, without any need for registration or timing marks.

In use, the panels are folded one way to enter information on the front of the original panel, and are folded another way to enter information on the back of the original panel. This information is reproduced on the back and front surfaces, respectively, of the copy panel. The form is then unfolded and the panels are separated along the fold line.

In an alternate configuration of the first embodiment of the invention, no carbonless coating is applied to the original panel 16. With reference to FIGS. 1–3, this indicates that there is no carbonless CB coating 30*a* and 30*b* on the original panel. Reproduction of information entered in the areas 24 and 34 on the front and back surfaces, respectively, of the original panel onto areas 28 and 38, respectively, of the copy panel is accomplished by applying a "Self-Contained" (SC) carbonless coating to the areas 28 and 38 of the copy panel. A Self-Contained (SC) carbonless coating is essentially a mixture of carbonless CB and CF coatings.

In another alternate configuration of the first embodiment of the invention, the original panel is substantially fully coated on its front and back surfaces with carbonless CB treatment, and the copy panel is substantially fully coated on its front and back surfaces with carbonless CF treatment.

Second Embodiment

Figure 5:
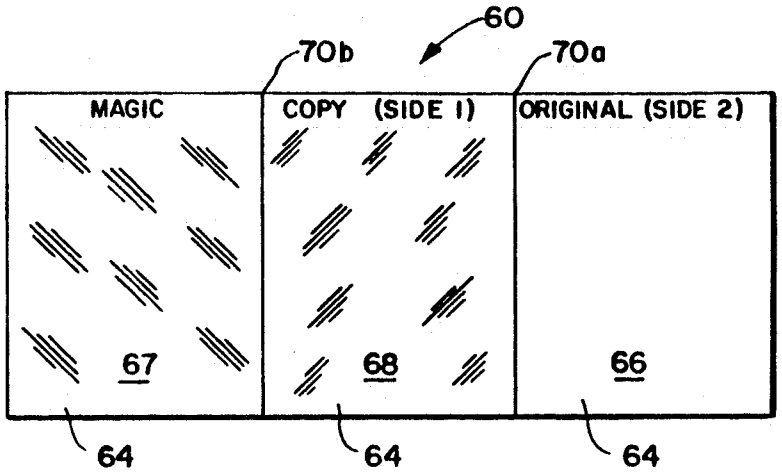
FIGS. 4, 5 and 6 are top plan, bottom plan and cross-sectional views, respectively, of the second embodiment of the invention.
Figure 4:
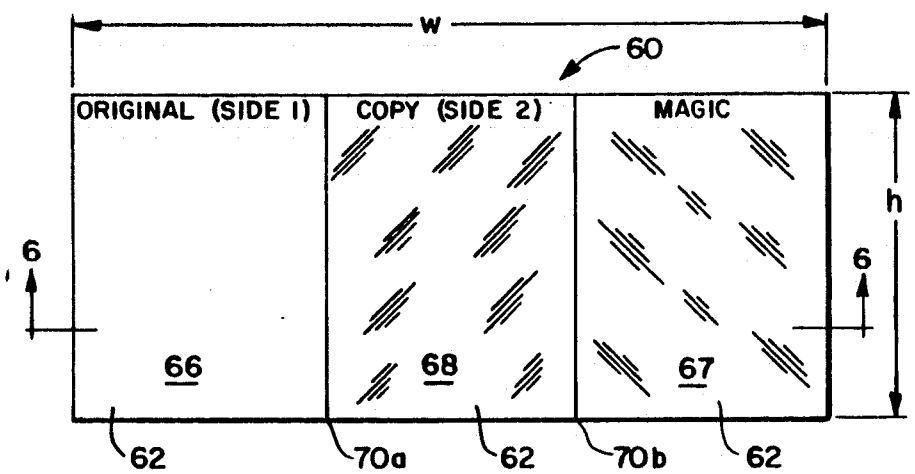
Figure 6:
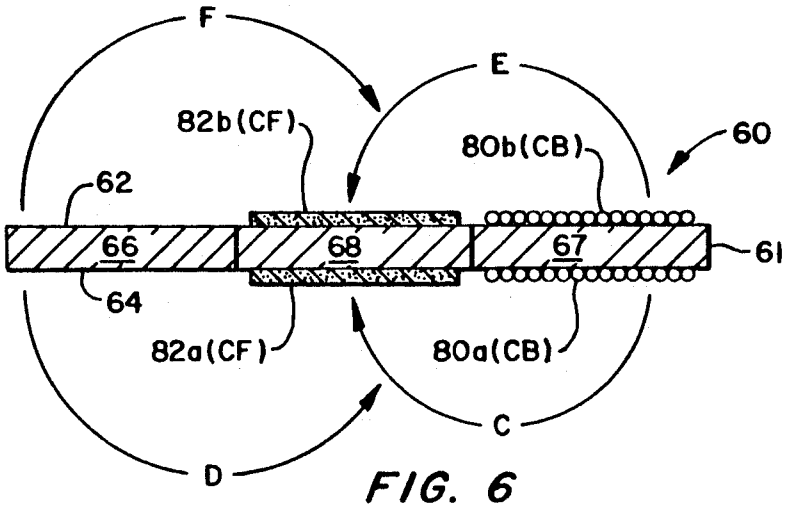

FIGS. 4, 5 and 6 show a self-replicating form 60 comprising a single sheet of paper 61 having a front surface 62 and a back surface 64. The sheet is divided into an "original" panel 66, a "magic", image-transferring panel 67 and a "copy" panel 68 by two fold lines 70*a* and 70*b*. The fold lines are provided with a series of perforations for folding and separating the three panels 66, 67 and 68.

When the form 60 is folded in a first direction along the fold lines, the original and copy panels are in back-to-back relationship, as indicated by the arrows "C" and "D", and the "magic" panel is interposed between the original and copy panels. A carbonless CB treatment 80*a* is applied to substantially the entire back surface of the "magic" panel, and a carbonless CF treatment 82*a* is applied to substantially the entire back surface of the copy panel. In this manner, variable information entered on the front surface of the original panel is reproduced on the back surface of the copy panel.

When the form 60 is folded in a second direction along the fold lines, the original and copy panels are in front-to-front relationship, as indicated by the arrows "E" and "F", and the magic panel is interposed between the original and copy panels. A carbonless CB treatment 80b is applied to substantially the entire front surface of the magic panel, and a carbonless CF treatment 82b is applied to substantially the entire front surface of the copy panel. In this manner, variable information entered on the back surface of the original panel is reproduced on the front surface of the copy panel.

In use, the panels are folded one way to enter information on the front of the original panel, and are folded another way to enter information on the back of the original panel. This information is reproduced on the back and front surfaces, respectively, of the copy panel. The form is then unfolded, the panels are separated along the fold lines and the magic panel is discarded.

Alternate configurations of the original, copy and magic panels are within the scope of this invention. For instance, either the original or magic panels can be the middle panel (as viewed in the Figures), and the copy panel can be an end panel. In the case of both the original and copy panels being end panels, and the magic panel being the middle panel, the form must be folded in a zig-zag manner to be interposed between the original and copy panels, and information entered on the front and back surfaces of the original panel is reproduced on the front and back surfaces, respectively, of the copy panel.

In all of these configurations of the second embodiment, the original panel is uncoated, the copy panel is substantially fully coated on both its front and back surfaces with carbonless CF treatment, and the magic panel (or separate sheet) is substantially fully coated on both its front and back surfaces with carbonless CB treatment.

In yet another configuration of this embodiment, the magic panel is provided as a separate sheet of paper to be inserted between the original and copy panels which are formed of a single sheet of paper, and the magic sheet is coated on at least one surface with CB treatment. If only one surface of the magic sheet is CB-coated, this surface must always be in contact with the CF-coated surfaces of the copy panel. Preferably, both surfaces of the magic sheet are CB-coated.

Third Embodiment

Figure 8:
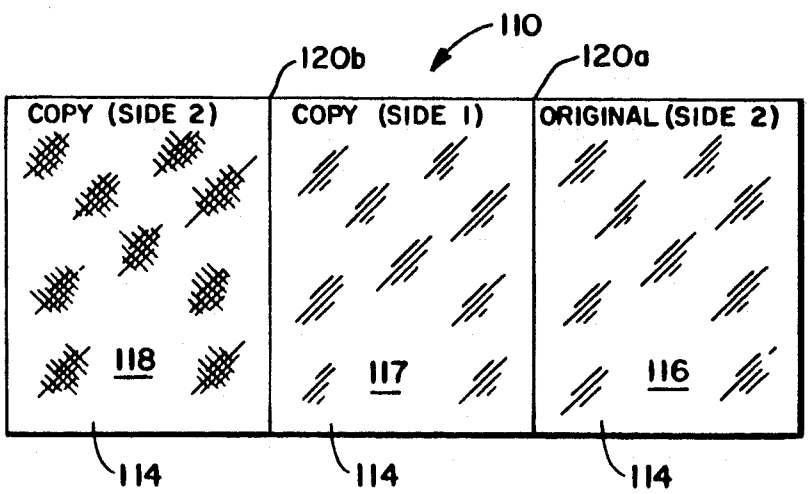
FIGS. 7, 8 and 9 are top plan, bottom plan and cross-sectional views, respectively, of the third embodiment of the invention.
Figure 7:
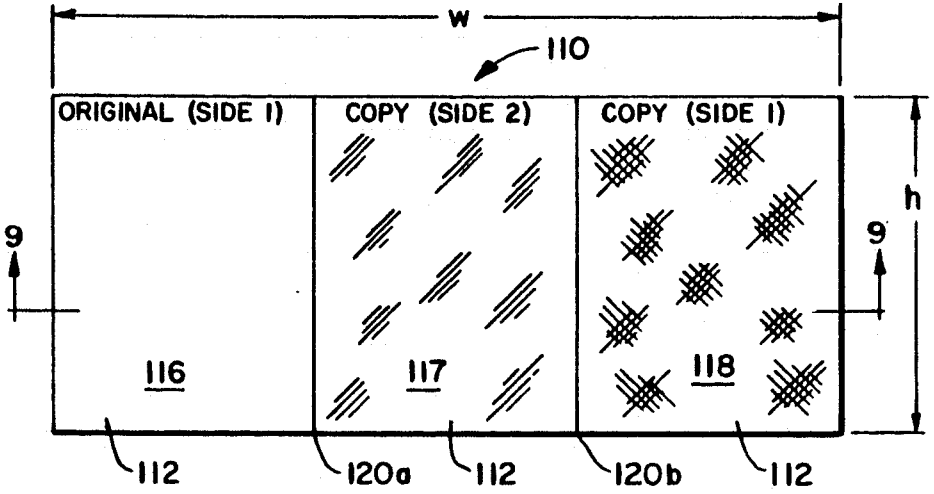
Figure 9:
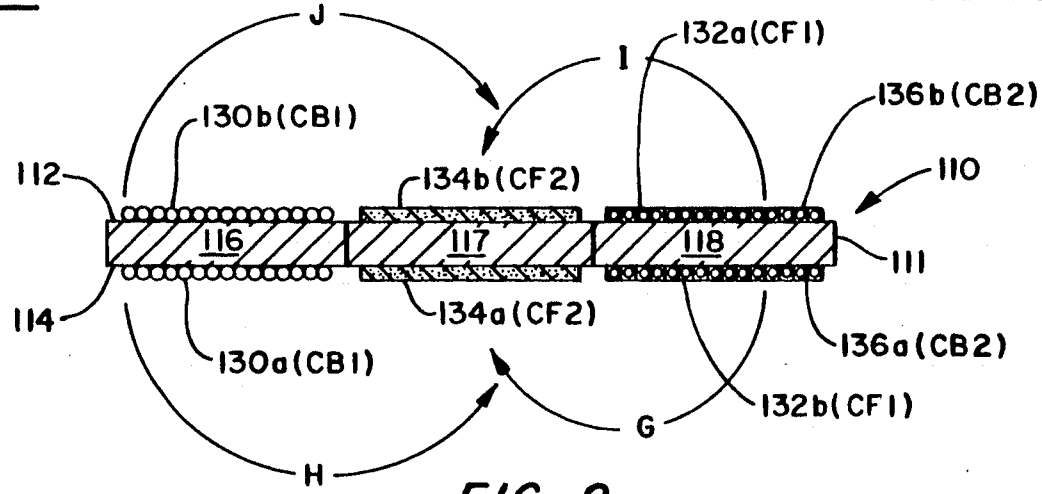

FIGS. 7, 8 and 9 show a self-replicating form 110 comprising a single sheet of paper 111 having a front surface 112 and a back surface 114. The sheet is divided into an "original" panel 116, a first copy panel 117 and a second copy panel 118 by two fold lines 120a and 120b. The fold lines are preferably provided with a series of perforations for aiding in folding and separating the three panels 116, 117 and 118.

When the form 110 is folded in a first direction along the fold lines, the original and first copy panels 116, 117 are in back-to-back (facing, not touching) relationship, and the second copy panel 118 is interposed between the original and first copy panels, as indicated by the arrows "G" and "H". A carbonless CB treatment 130a selected from a first carbonless system, hereinafter termed "CB1", is applied to substantially the entire back surface of the original panel 116, and a carbonless CF treatment 132a selected from the first carbonless system, hereinafter termed "CF1" is applied to substantially the entire front surface of the second copy panel 118. In this manner, variable information entered on the front surface of the original panel 116 is reproduced on the front surface of the second copy panel 118.

Further, substantially the entire back surface of the second copy panel 118 is coated with a carbonless CB treatment 136a selected from a second carbonless system, hereinafter termed "CB2", and substantially the entire back surface of the first copy panel 117 is treated with a carbonless CF treatment 134a selected from the second carbonless system, hereinafter termed "CF2". In this manner variable information entered on the front surface of the original panel is reproduced, via the second copy panel 118, on the back surface of the first copy panel 117.

When the form 110 is folded in a second direction along the fold lines, the original and first copy panels are in front-to-front (facing) relationship, and the second copy panel is interposed between the original and first copy panels, as indicated by the arrows "I" and "J". A carbonless CB treatment 130b selected from the first carbonless system, hereinafter termed "CB1", is applied to substantially the entire front surface of the original panel 116, and a carbonless CF treatment 132b selected from the first carbonless system, hereinafter termed "CF1" is applied to substantially the entire back surface of the second copy panel 118. In this manner, variable information entered on the back surface of the original panel 116 is reproduced on the back surface of the second copy panel 118.

Further, substantially the entire front surface of the second copy panel 118 is coated with a carbonless CB treatment 136b selected from the second carbonless system, hereinafter termed "CB2", and substantially the entire front surface of the first copy panel 117 is treated with a carbonless CF treatment 134b selected from the second carbonless system, hereinafter termed "CF2". In this manner variable information entered on the back surface of the original panel is reproduced, via the second copy panel 118, on the front surface of the first copy panel 117.

It is seen that the second copy panel has a combination of CF1 and CB2 on both of its surfaces. In other words, each side thereof is coated with CB treatment from one carbonless system and is also coated with CF treatment from another, nonreactive carbonless system. The CB and CF treatments are suitably combined in the same manner as is used to make a Self-Contained (SC) coating, but with dissimilar CB and CF treatments such a mixture can hardly be characterized as self-contained. The purpose of this unique combination of coatings on the second copy panel is to allow for coating substantially the entire front and back surfaces of the panels, without causing them to form reverse images of information entered on the original panel. Normally, when combining CB and CF treatments together, a "Self-Contained" (SC) coating is formed which will form a copy image based on pressure alone, without requiring any coating on the "original" sheet. However, by selecting the CB and CF coatings from two dissimilar carbonless systems, a Self-Contained coating is not formed. The CF component of this unusual combination requires another sheet (or panel) coated with CB from a compatible carbonless system to reveal an image, and the CB component will reveal itself only on another sheet coated with CF from a compatible carbonless system.

It is important to understand that CB1 will react with CF1 but will not react with CF2, and that CB2 will react with CF2 but will not react with CF1. The combination of CB1 and CF1 form one carbonless system, and the combination of CB2 and CF2 form another, dissimilar carbonless system. Such two-system technology is disclosed in U.S. Pat. No. 4,062,567 in the context of forming CFB intermediate sheets for manifold sets, wherein the intermediate sheets have a carbonless CF front from one system and a carbonless CB back from another system.

In an alternate configuration of this embodiment, the original panel is not written upon, and is simply an image-transferring ("magic") panel. In this case, a fourth panel (not shown), devoid of carbonless coating, is formed from the sheet 110 and is folded in both directions against the image-transferring panel (e.g., 116). In a similar manner as was described with respect to the second embodiment (FIGS. 4–6), the original panel would be clear of any carbonless coating, but would cooperate with the image-transferring panel to transfer images to the copy panels.

What is claimed is:

1. Carbonless copy paper, consisting essentially of:

a single sheet of paper having a front surface and a back surface and delineated into three panels, an original panel, a first copy panel and a second copy panel;

carbonless coating applied to substantially the entire front and back surfaces of the original panel;

carbonless coating applied to substantially the entire front and back surfaces of the first copy panel; and carbonless coating applied to substantially the entire front and back surfaces of the second copy panel; wherein:

the first copy panel is disposed between the original and second copy panels;

the original panel is coated with a first carbonless system CB coating on both surfaces;

the second copy panel is coated with a first carbonless CF coating on both surfaces reactive with the first carbonless system CB coating and with a second carbonless system CB coating on both surfaces that is not reactive with the first carbonless system CF coating; and the first copy panel is coated with a second carbonless CF coating on both surfaces which is reactive with the second carbonless system CB coating.

2. Carbonless form, comprising:

a single sheet of paper having a front surface, a back surface and divided into at least three panels;

an original panel having a front surface formed by the front surface of the sheet and a back surface formed by the back surface of the sheet;

a first copy panel having a front surface formed by the front surface of the sheet and a back surface formed by the back surface of the sheet; and a second copy panel having a front surface formed by the front surface of the sheet and a back surface formed by the back surface of the sheet; and wherein:

the first copy panel is disposed between the original and second copy panels;

the original panel is coated with a first carbonless system CB coating on its front and back surfaces;

the second copy panel is coated with a mixture of a first carbonless system CF coating and a second carbonless system CB coating on its front and back surfaces, wherein the first carbonless and is not reactive with the second carbonless system CB coating; and the first copy panel is coated with a second carbonless CF coating which is reactive with the second carbonless system CB coating; whereby information entered on both surfaces of the original panel is reproduced on both surfaces of the second and first copy panels.

* * * * *

UNITED STATES PATENT AND TRADEMARK OFFICE

CERTIFICATE OF CORRECTION

PATENT NO. : 5,154,668

DATED : 10/13/92

INVENTOR(S) : Keith E. Schubert and Gerald E. Linden

It is certified that error appears in the above-identified patent and that said Letters Patent is hereby corrected as shown below:

The inventor's addresses should read as:

Keith E. Schubert
4 Timothy Road
West Norwalk, CT 06850

Gerald E. Linden
2008 Cotswold Dr.
Orlando, FL 32825

Signed and Sealed this

Twenty-eighth Day of December, 1993

*Attest:*

Bruce Lehman

BRUCE LEHMAN

*Attesting Officer*

*Commissioner of Patents and Trademarks*